US007231914B2

(12) United States Patent
Hatcher

(10) Patent No.: US 7,231,914 B2
(45) Date of Patent: Jun. 19, 2007

(54) FEED PORT FOR PNEUMATIC PROJECTILE DEVICE

(76) Inventor: Forest A Hatcher, PO Box 1555, Fiagier Beach, FL (US) 32136

( * ) Notice: Subject to any disclaimer, the term of this patent is extended or adjusted under 35 U.S.C. 154(b) by 849 days.

(21) Appl. No.: 10/083,800

(22) Filed: Feb. 26, 2002

(65) Prior Publication Data

US 2005/0241628 A1 Nov. 3, 2005

(51) Int. Cl.
*F41B 11/02* (2006.01)

(52) U.S. Cl. ..... 124/83; 124/49; 124/73; 124/74

(58) Field of Classification Search ..... 124/45, 124/49, 56, 73, 74, 76, 83, 84
See application file for complete search history.

(56) References Cited

U.S. PATENT DOCUMENTS

| | | | | | |
|---|---|---|---|---|---|
| 1,205,166 | A * | 11/1916 | Dettra | ..... | 124/29 |
| 3,789,891 | A * | 2/1974 | Bosch | ..... | 141/331 |
| 5,257,615 | A * | 11/1993 | Jones | ..... | 124/56 |
| 5,832,911 | A * | 11/1998 | Mayville et al. | ..... | 124/73 |
| 6,055,975 | A * | 5/2000 | Gallagher et al. | ..... | 124/50 |
| 6,273,079 | B1 * | 8/2001 | Jzn | ..... | 124/49 |
| 6,347,622 | B1 * | 2/2002 | Hsueh | ..... | 124/49 |

* cited by examiner

*Primary Examiner*—John A. Ricci
(74) *Attorney, Agent, or Firm*—Ryan, Kromholz & Manion S.C.

(57) ABSTRACT

An improved feed port for a pneumatic projectile device comprising a moveable feed port aperture attached to a pneumatic device through which projectiles can be introduced to the breech of the pneumatic device, the feed port having an aperture permitting the free flow of projectiles from an external source.

4 Claims, 3 Drawing Sheets

FEED PORT FOR PNEUMATIC PROJECTILE DEVICE

BACKGROUND OF THE INVENTION

The Improved Feed Port for Pneumatic Projectile Devices is designed to allow existing projectile devices with standard feed mechanisms, (the method for loading a projectile from a magazine into the breech of the device gun and commonly referred to in the industry as direct feeds and powerfeeds, depending upon the orientation of the feed port to the breech) to utilize new and emerging technologies which move the paintball magazine from a top loading, gravity-based feed mechanism to a bottom or side feed pneumatic and/or mechanically based feed mechanism.

Direct feed systems can take one of several configurations. However, each direct feed system currently on the market or which is a reasonable variation thereof, comprises the following features:

The axis of the direction of the feed is not parallel to the axis of the paintball gun's barrel. The projectiles drop directly into the breech from the feed and flow into the breech in the same direction as the main axis of the feed.

The feed is oriented to the breech so that when the paintball gun is held in a normal firing position, the breech is below the feed.

Power feed systems can take one of several different configurations. However, all configurations and variants thereof share the following features:

The axis of the direction of the feed is not parallel to the axis of the paintball gun's barrel The projectiles pass through the feed in a direction which is off-center from dropping directly into the breach and therefore must, under the influence of a device placed in the powerfeed, change direction in order to enter the breach.

Because of the different designs of the existing (and anticipated) feed methods, the multi-purpose feed adapter must necessarily be configured in several different ways in order to function properly.

Furthermore, it is anticipated by the designers that others may wish to modify existing projectile devices to operate in a manner similar to that as provided for in this application. In anticipation of that, a method for modifying existing guns to incorporate a non-gravity based feed system is included here.

SUMMARY OF THE INVENTION

Therefore, the improved feed port for pneumatic projectile devices has been designed to incorporate the beneficial features of a variety of different, previously utilized devices, enhances the utility of such devices by allowing them to be moved into different configurations and providing the feed port with the ability to accommodate new and emerging technologies which may or may not use gravity as their method of feeding projectiles into the breech.

DETAILED DESCRIPTION

One of the exemplary embodiments provides an improved feed port moveably attached to and integrated into the design of a pneumatic projectile device 15. In general, a pneumatic projectile device 15 comprises a breech having a front end, a rear end, a main longitudinal passageway with a first opening at its front end, and a second opening in said passageway for entry of compressed gas into the passageway. The projectile device 15 further includes a means for supplying compressed gas from a source thereof to the second opening in the passage.

The pneumatic projectile device 15 also includes a gun handle connected to said receiver and a barrel 10 through which the pellets or balls are fed is connected to the front end of the breech. Also provided is a bolt or other means for moving the ball or pellet from the breech into the barrel, the operation of the bolt being actuated by the trigger mechanism. A valve mechanism or valve actuating mechanism or other mechanical, pneumatic or electronic mechanism is actuated by the operation of the trigger. The valve actuating mechanism is also capable of opening a gas valve mounted in the receiver upon demand.

The pneumatic projectile device may further comprise a gas valve system, the system including a sealed gas passageway connected to the second opening in the longitudinal passageway. The gas valve system is constructed to release compressed gas in order to fire a pellet or ball when the valve actuating mechanism is activated by a trigger.

A preferred embodiment provides for a trigger mounted to a lower portion of the breech, the trigger having a means for operating the valve actuating mechanism. The valve actuating mechanism also provides means for returning the trigger to a forward position upon release of the trigger as well as a means for sealing the opening in the side of the longitudinal passageway of the housing upon activation of the valve mechanism.

A preferred embodiment of the pneumatic projectile device 15 provides for an opening in the side of the longitudinal passageway of the housing of the pneumatic projectile device 15. The pneumatic projectile device 15 is equipped with a tubular element of variable length attached either in a temporary or permanent manner; the tubular element comprising a body with a substantially circular passageway with a opening at its front end and a opening at its rear end. The opening at the rear end of the tubular element is in communication with the opening in the side wall of the housing, such that pellet or balls may freely move between the tubular element and the longitudinal passageway of the housing. Preferred embodiments also provide for a means for selectively fixing or unfixing the location of the feed port opening, said means being a collet, a set screw 45, a latch arm or similar device.

Figure 1:
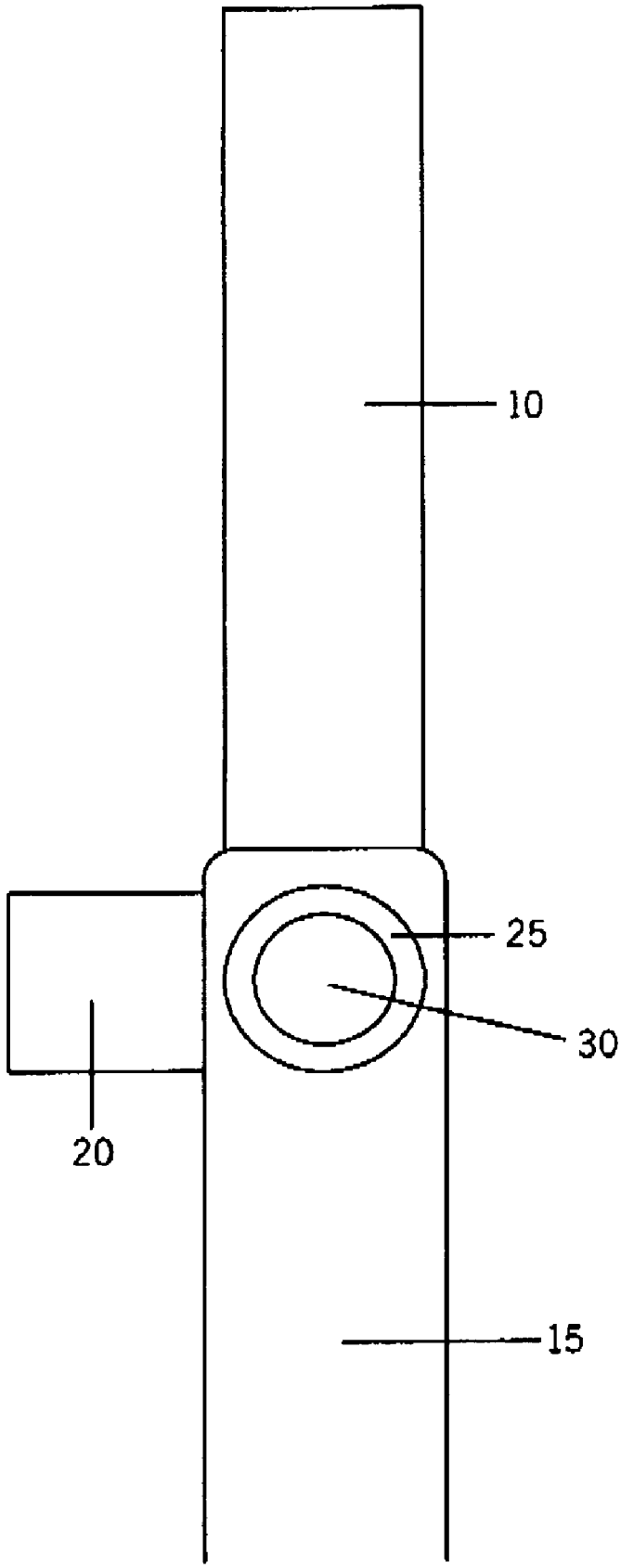
FIG. 1 PRIOR ART
FIG. 1 shows a top view of a conventional pneumatic projectile device, and references the location of a feed port 0 in a vertical configuration in relation to the receiver and breech of the pneumatic projectile device and feed port in a side or straight feed mounting.
Figure 2:
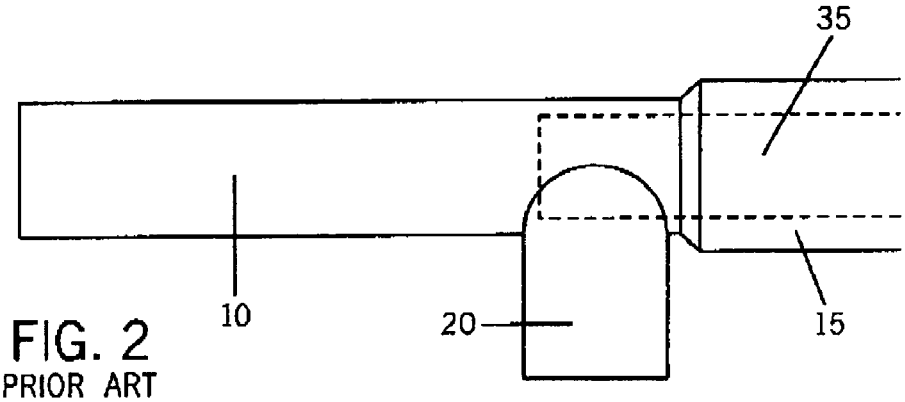
FIG. 2 PRIOR ART
FIG. 2 shows a top view of a conventional pneumatic projectile device with a feed port and a bolt (in shadow) extended to reach past the feed port and seal the breech.
Figure 3:
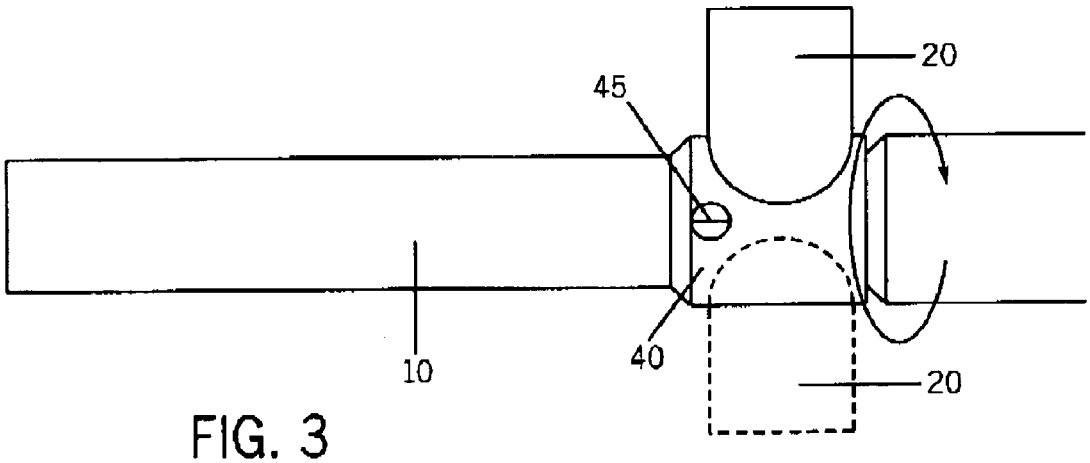
FIG. 3 shows the Improved Feed Adapter mounted on the forward end of the receiver, the barrel mounted to the forward end of the Improved Feed Adapter, the ability of the adapter to move the location of the feed port and the set screw used to retain the housing in a fixed position.
Figure 4:
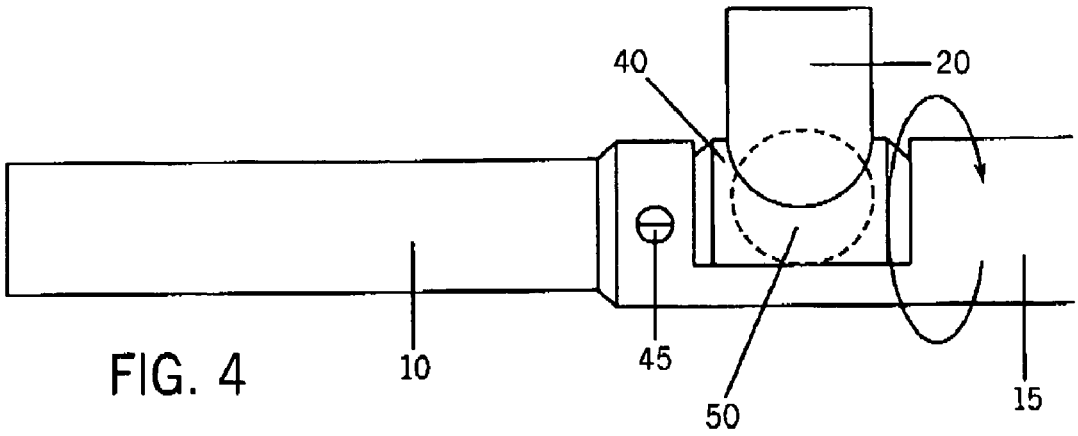
FIG. 4 shows pneumatic projectile device receiver in an alternate embodiment of the device, fitted into a cavity in the body of the receiver.
Figure 5:
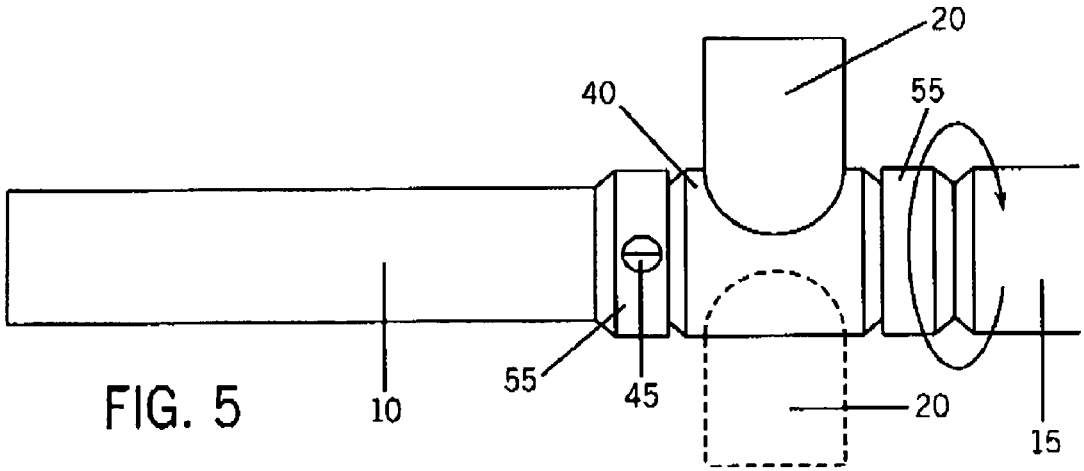
FIG. 5 shows the preferred embodiment of the device illustrating the movement of the feed port, the housing containing the feed port aperture, the barrel fixed to the front of the feed port and the set screw for retaining the feed port in a fixed position.

FIG. 5 illustrates one preferred embodiment of the device and shows the pneumatic projectile device body 15 attached via a threaded adapter 55 to its front end, the movable collar 40 attached to the threaded adapter 55, the forward adapter 55 into which the barrel 10 is attached, the feed tube attached to the aperture 20 and the set screw 45 which passes through the adapter and makes contact with the surface of collar 40 and prevents movement thereof.

In use, the adapter unit 55 is threaded onto the receiver of a pneumatic projectile device 15, after which the barrel 10 is threaded onto the forward portion of the adapter 55, the barrel 10, the housing 55 and the pneumatic projectile device 15 becoming a single unit. The set screw 45 is then backed out, allowing the housing 40 to be rotated until the feed port aperture 20 is in the desired location, after which the set screw 45, is tightened to prevent further movement of the housing 40.

I claim:

1. A pneumatic projectile device having an improved feed port comprising:

a housing having a front end, a rear end, a main longitudinal passage through which projectiles can be fired with a first opening at its front end, a second opening at its rear end and a aperture in the side of said main longitudinal passage through which projectiles can be introduced to said passage;

a means for moving said housing; a means for retaining said housing in a fixed position;

a breech having a front end, a rear end, a main longitudinal passage with a first opening at its front end, and a second opening in said passage for entry of compressed gas into said passage; a means for supplying compressed gas from a source thereof to said second opening;

a barrel through which said pellets or balls are fed connected to said front end of said breech;

a bolt means for moving the ball or pellet from the breech into the barrel, the operation of said bolt means actuated by the trigger mechanism, the valve mechanism or other mechanical, pneumatic or electronic mechanism which can be actuated by the operation of the trigger;

a valve actuating mechanism mounted in said receiver, the valve actuating mechanism being capable of opening a gas valve mounted in said receiver upon demand;

a gas valve system, said system including a sealed gas passage connected to said second opening and being constructed to release compressed gas in order to fire a pellet or ball when said valve actuating mechanism is activated;

a trigger mounted to a lower portion of the breech, said trigger having a means for operating said valve actuating mechanism; means for returning said trigger to a forward position upon release of the trigger;

a means for sealing the opening in the side of the longitudinal passage of said housing upon activation of the valve mechanism; and a moveable feed port aperture attached to the housing of the pneumatic projectile device, the moveable feed port aperture being operable to move to different positions, said moveable feed port being operable to introduce projectiles to the breech of the projectile device, comprising:

a aperture of sufficient size to allow the freely flowing introduction of projectiles from an external source;

a means for moving the location of the aperture; and a means for retaining the aperture in a fixed position.

2. The improved feed port of claim 1 wherein the feed port is of variable length and is attached either in a temporary or permanent manner, said feed port comprising a body with a substantially circular passage with an opening at its front end and an opening at its rear end, the opening at its rear end being in communication with the opening in the side wall of the housing, such that pellet or balls may freely move between the feed port and the longitudinal passage of the housing.

3. The improved feed port of claim 1 wherein the housing of the projectile device incorporates a means for selectively fixing or unfixing the location of the feed port.

4. An improved feed port moveably attached to and integrated into the design of a pneumatic projectile device, the pneumatic projectile device comprising;

a breech having a front end, a rear end, a main longitudinal passage with a first opening at its front end, and a second opening in said passage for entry of compressed gas into said passage, passage means for supplying compressed gas from a source thereof to said second opening;

a barrel through which said pellets or balls are fed connected to said front end of said breech;

a bolt or other means for moving the ball or pellet from the breech into the barrel, the operation of said bolt actuated by the trigger mechanism, the valve mechanism or other mechanical, pneumatic or electronic mechanism which can be actuated by the operation of the trigger;

a valve actuating mechanism mounted in said receiver, capable of opening a gas valve mounted in said receiver upon demand;

a gas valve system, said system including a sealed gas passage connected to said second opening and being constructed to release compressed gas in order to fire a pellet or ball when said valve actuating mechanism is activated;

a trigger mounted to a lower portion of the breech, said trigger having a means for operating said valve actuating mechanism; means for returning said trigger to a forward position upon release of the trigger;

a means for sealing the opening in the side of the longitudinal passage of said housing upon activation of the valve mechanism;

an opening in the side of the longitudinal passage of the housing with a feed port of variable length attached either in a temporary or permanent manner;

said feed port comprising a body with a substantially circular passage with a opening at its front end and a opening at its rear end, the opening at its rear end being in communication with the opening in the side wall of the housing, such that pellet or balls may freely move between the feed port and the longitudinal passage of the housing;

the improved feed port comprising:

a moveable aperture attached to a pneumatic projectile device;

a housing having a front end, a rear end, a main longitudinal passage through which pellets or balls can be fired with a first opening at its front end, a second opening at its rear end and a opening in the side of said passage through which pellets or balls can be introduced to said passage;

a means for moving said housing;

a means for retaining said housing in a fixed position; and a means for selectively fixing or unfixing the location of the feed port opening.

* * * * *